US010465537B2

(12) United States Patent
Burdgick et al.

(10) Patent No.: US 10,465,537 B2
(45) Date of Patent: Nov. 5, 2019

(54) MARGIN BUCKET DOVETAIL RADIAL SUPPORT FEATURE FOR AXIAL ENTRY BUCKETS

(71) Applicant: General Electric Company, Schenectady, NY (US)

(72) Inventors: Steven Sebastian Burdgick, Schenectady, NY (US); John Ligos, Schenectady, NY (US); Thomas Joseph Farineau, Schoharie, NY (US)

(73) Assignee: General Electric Company, Schenectady, NY (US)

( * ) Notice: Subject to any disclaimer, the term of this patent is extended or adjusted under 35 U.S.C. 154(b) by 470 days.

(21) Appl. No.: 15/281,562

(22) Filed: Sep. 30, 2016

(65) Prior Publication Data

US 2017/0342845 A1 Nov. 30, 2017

Related U.S. Application Data

(60) Provisional application No. 62/342,355, filed on May 27, 2016.

(51) Int. Cl.
*F01D 5/32* (2006.01)

(52) U.S. Cl.
CPC ..... *F01D 5/323* (2013.01); *F05D 2220/31* (2013.01); *F05D 2230/60* (2013.01); *F05D 2260/30* (2013.01)

(58) Field of Classification Search
CPC ..... F01D 5/323
See application file for complete search history.

(56) References Cited

U.S. PATENT DOCUMENTS

| | | | | |
|---|---|---|---|---|
| 2,942,842 | A * | 6/1960 | Hayes | F01D 5/30 416/220 R |
| 2,971,743 | A * | 2/1961 | Welsh | F01D 5/225 416/191 |
| 5,236,309 | A * | 8/1993 | Van Heusden | F01D 5/323 416/206 |
| 5,431,543 | A * | 7/1995 | Brown | F01D 5/26 29/889.21 |
| 9,739,160 | B2 * | 8/2017 | Kain | F01D 5/3007 |
| 9,909,431 | B2 * | 3/2018 | Polyzopoulos | F01D 5/3007 |
| 2007/0119174 | A1 | 5/2007 | Russo | |
| 2009/0022599 | A1 | 1/2009 | Beulick | |
| 2012/0034086 | A1 | 2/2012 | Mishrikotkar | |
| 2013/0170996 | A1 | 7/2013 | Farineau | |
| 2013/0330198 | A1 | 12/2013 | Farineau | |
| 2013/0330204 | A1 | 12/2013 | Farineau | |
| 2014/0127026 | A1 | 5/2014 | Farineau | |
| 2015/0110635 | A1 | 4/2015 | Kain et al. | |

(Continued)

OTHER PUBLICATIONS

Copy of International Search Report and Written Opinion issued in connection with corresponding PCT Application No. PCT/US2017/033752 dated Jul. 25, 2017.

*Primary Examiner* — Woody A Lee, Jr.
(74) *Attorney, Agent, or Firm* — Eversheds Sutherland (US) LLP

(57) ABSTRACT

The present application provides a steam turbine. The steam turbine may include a number of rotor wheel slots, a number of buckets positioned in the rotor wheel slots, and a radial support assembly positioned between each of the buckets and each of the rotor wheel slots. The radial support assembly may include one or springs and one or more shims.

18 Claims, 9 Drawing Sheets

(56) References Cited

U.S. PATENT DOCUMENTS

| | | | | |
|---|---|---|---|---|
| 2015/0167469 | A1 | 6/2015 | Deallenbach | |
| 2015/0167471 | A1 | 6/2015 | Deallenbach | |
| 2015/0176417 | A1 | 6/2015 | Zelmer | |
| 2018/0087388 | A1* | 3/2018 | Kalochairetis | F01D 5/326 |

* cited by examiner

MARGIN BUCKET DOVETAIL RADIAL SUPPORT FEATURE FOR AXIAL ENTRY BUCKETS

RELATED APPLICATION

The present application is a non-provisional application claiming priority to Provisional Application Ser. No. 62/342,355, filed on May 27, 2016. Provisional Application Ser. No. 62/342,355 is incorporated by reference herein in full.

TECHNICAL FIELD present application and the resultant patent relate generally to steam turbines and more particularly relate to margin bucket dovetail radial support features for axial entry buckets used with low pressure steam turbines and the like.

BACKGROUND OF THE INVENTION

At least some known turbine engines, such as gas turbines and steam turbines, use axial entry buckets, i.e., rotor blades that are coupled to a rotor wheel by sliding the buckets generally parallel to the rotor axis into mating dovetail slots defined on the rotor wheel. Likewise, some known buckets include radial-inwardly projecting dovetails that mate in dovetail slots formed on the rotor wheel. The rotor wheel dovetail slots are circumferentially-spaced apart from each other about the periphery of the rotor wheel The majority of last stage buckets are of significant length and weight. During low speed (turning gear) operation, the buckets have the ability to move within the rotor dovetails. This unwanted movement may cause significant wear on the buckets and/or the rotor dovetails of the axial or curved axial entry bucket designs. It may be desirable to have some movement to facilitate the assembly of the buckets, as the outer cover ends typically have interlocking features and also may have mid-span interlocking features. Moreover, the buckets must pass each other during assembly of the last bucket in the row assembly. Springs are traditionally used to keep the bucket loaded on the outer dovetail surfaces but such configurations may have operational limitations that are not desired.

SUMMARY OF THE INVENTION

The present application and the resultant patent thus provide a steam turbine. The steam turbine may include a number of rotor wheel slots, a number of buckets positioned in the rotor wheel slots, and a radial support assembly positioned between each of the buckets and each of the rotor wheel slots. The radial support assembly may include one or more springs and one or more shims. The one or more shims may include a middle shim, a locking shim, and/or an end shim.

The present application and the resultant patent further provide a method of bucket assembly on a rotor wheel. The method may include the steps of axially inserting a first number of buckets into a rotor wheel slot, positioning a middle shim assembly between the first number of buckets and the rotor wheel slot, axially inserting a second number of buckets into the rotor wheel slot, and positioning a locking shim assembly between the second number of buckets and the rotor wheel slot.

The present application and the resultant patent further provide a steam turbine. The steam turbine may include a number of rotor wheel dovetail slots, a number of bucket dovetails positioned in the rotor wheel dovetail slots, and a radial support assembly positioned between each of the bucket dovetails and each of the rotor wheel dovetail slots. The radial support assembly including one or springs positioned in one or more spring pockets and one or more shims.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
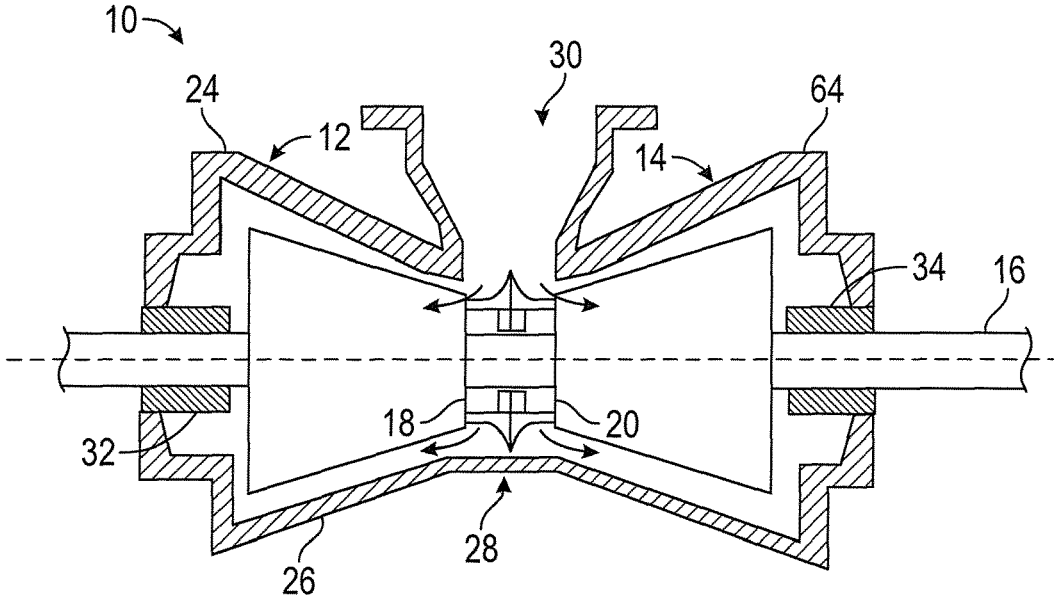
FIG. 1 is a schematic diagram of a low pressure steam turbine.

Referring now to the drawings, in which like numerals refer to like elements throughout the several views, FIG. 1 is a schematic diagram of an exemplary opposed-flow, low pressure steam turbine 10. The steam turbine 10 includes first and second low pressure sections 12 and 14. Each turbine section 12 and 14 includes a number of stages of diaphragms. A rotor wheel 16 extends through the sections 12 and 14. Each low pressure section 12 and 14 includes a nozzle 18 and 20. A single outer shell or casing 22 is divided along a horizontal plane and axially into upper and lower half sections 24 and 26, respectively, and spans both low pressure sections 12 and 14. A central section 28 of the shell 22 includes a low pressure steam inlet 30. Within the outer shell or casing 22, low pressure sections 12 and 14 are arranged in a single bearing span supported by journal bearings 32 and 34. A flow splitter may extend between the first and second low pressure turbine sections 12 and 14.

Figure 2:
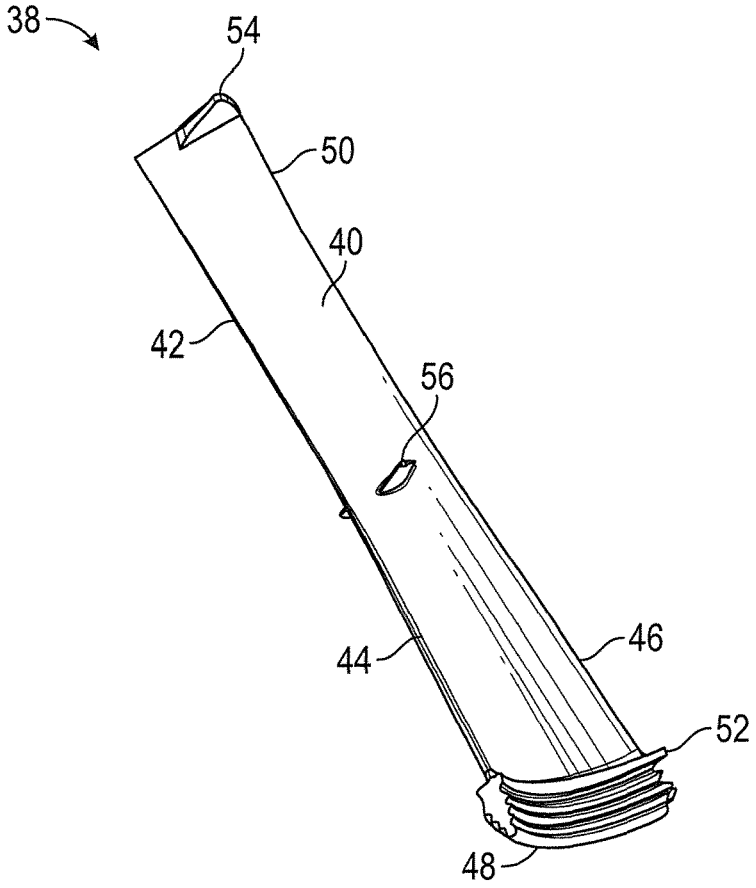
FIG. 2 is a perspective view of a bucket.

FIG. 2 is a perspective view of a steam turbine low pressure long bucket 38 used with the turbine 10. The turbine bucket 38 includes a pressure side 40 and a suction side 42 connected together at a leading edge 44 and a trailing edge 46. The pressure side 40 is generally concave and the suction side 42 is generally convex. The turbine bucket 38 includes a dovetail 48, an airfoil portion 50, and a root 52 extending therebetween. The airfoil portion 50 extends radially outward from the root 52 and increases in length to a tip 54 of the bucket 38. The airfoil portion 50 may include a mid-span connection 56 thereon. The bucket 38 couples to the rotor wheel 16 via the dovetail 48 and extends radially outward from the rotor shaft 16.

Figure 3:
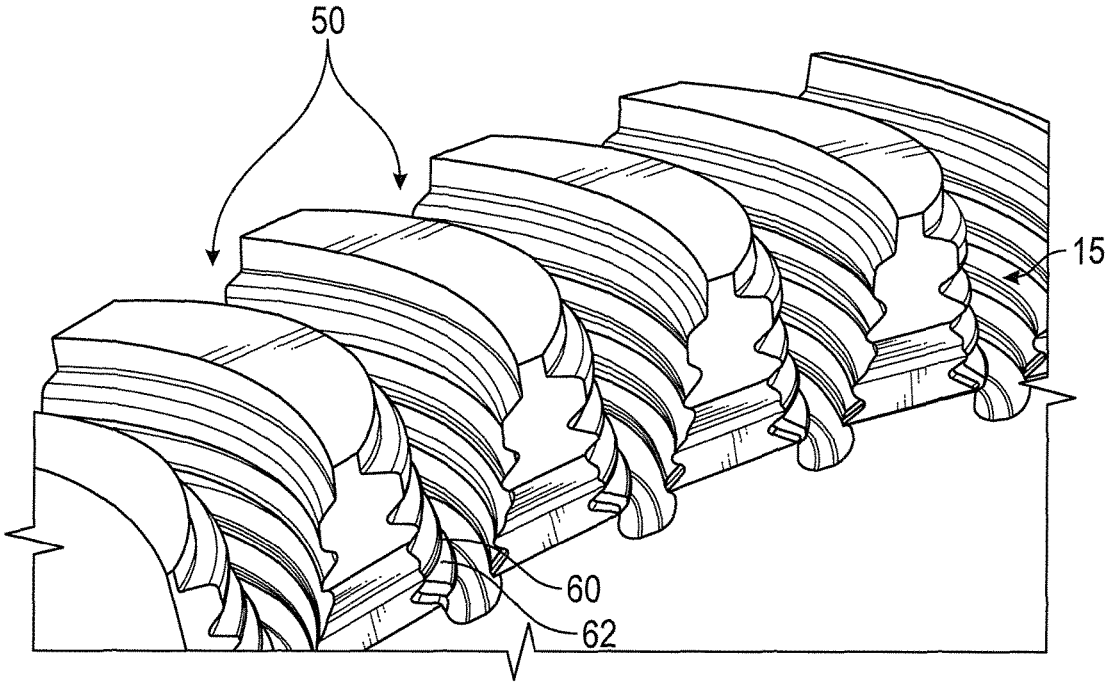
FIG. 3 is a perspective view of a rotor wheel.

As is shown in FIG. 3, the rotor wheel 16, in turn, has a number of complimentary shaped dovetail slots 58. The dovetail slots 58 extend around the rotor wheel 16 for axial entry of the buckets 38. Each dovetail slot 58 may be generally V-shaped and includes a series of axially extending projections 60 and grooves 62 that correspond to those of the dovetail 48. The dovetail slots 58 may be parallel or at an angle with respect to a centerline axis.

Figure 5:
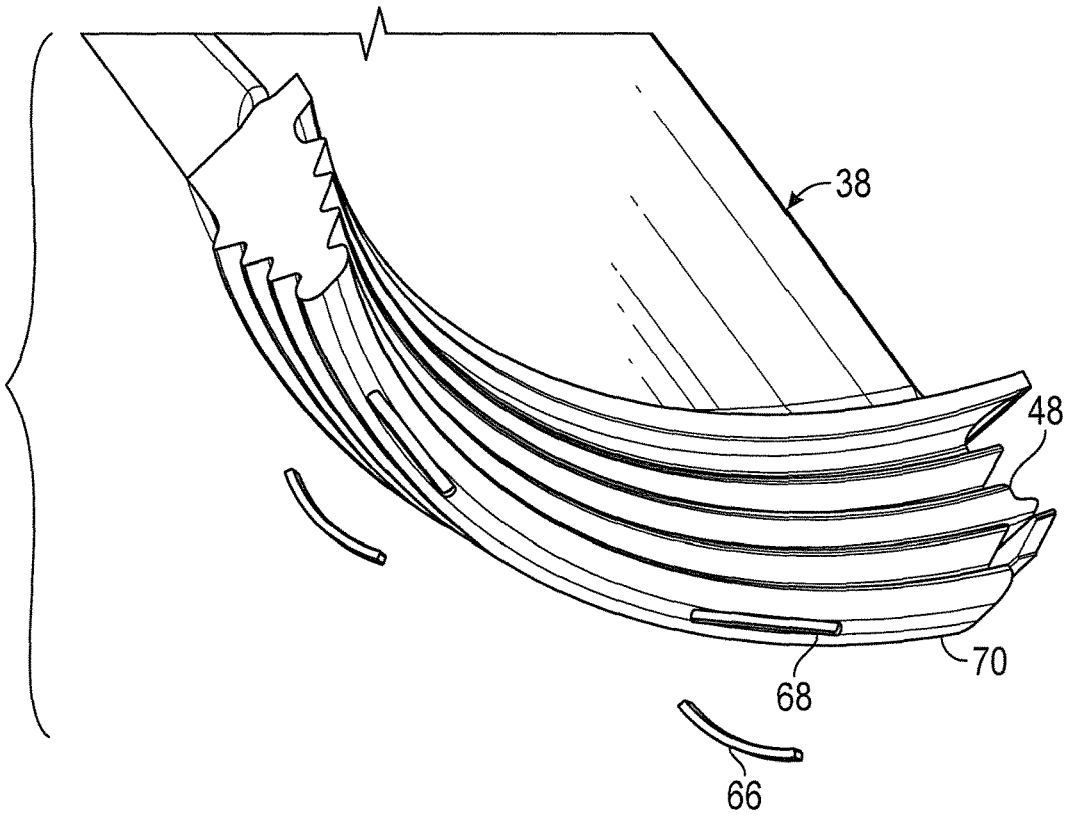
FIG. 5 is a perspective view of a bucket dovetail with springs.
Figure 6:
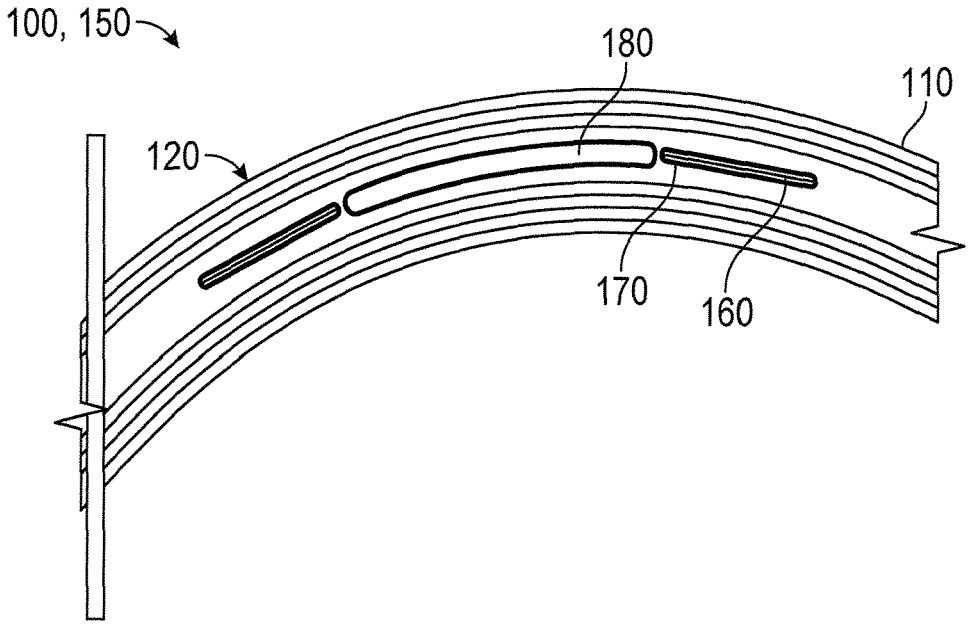
FIG. 6 is a bottom view of a bucket with a middle shim assembly of a radial support assembly as may be described herein.
Figure 7:
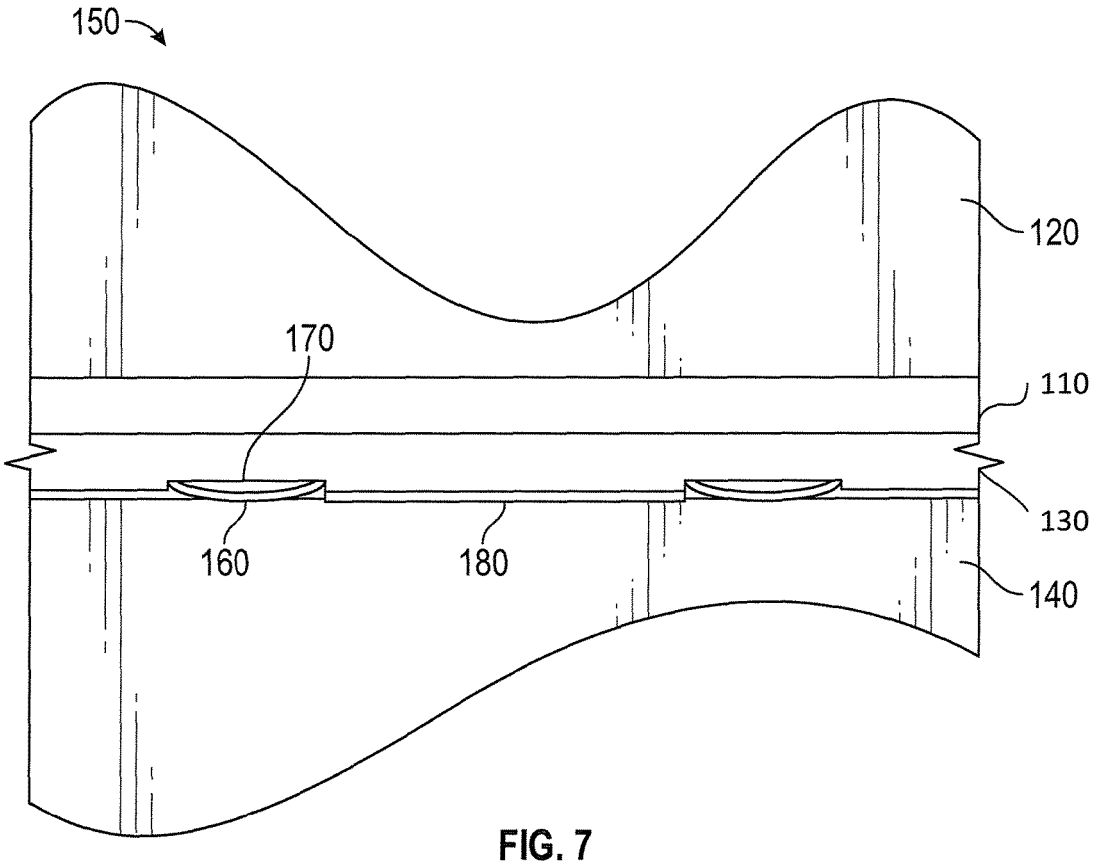
FIG. 7 is a side view of the middle shim assembly of the radial support assembly of FIG. 6.
Figure 8:
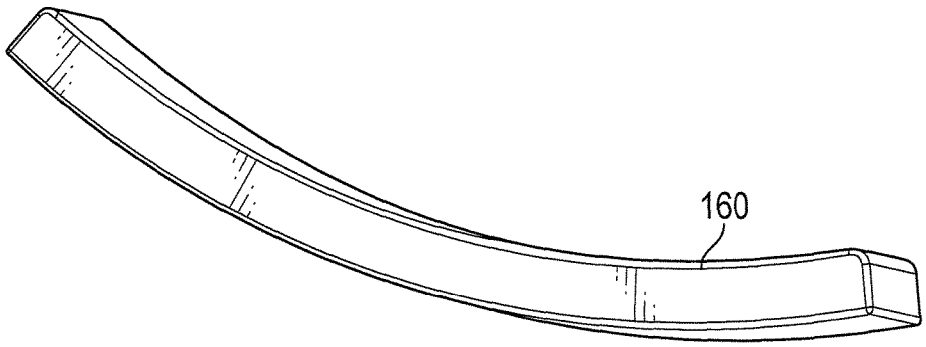
FIG. 8 is a perspective view of a spring of the middle shim assembly.
Figure 9:
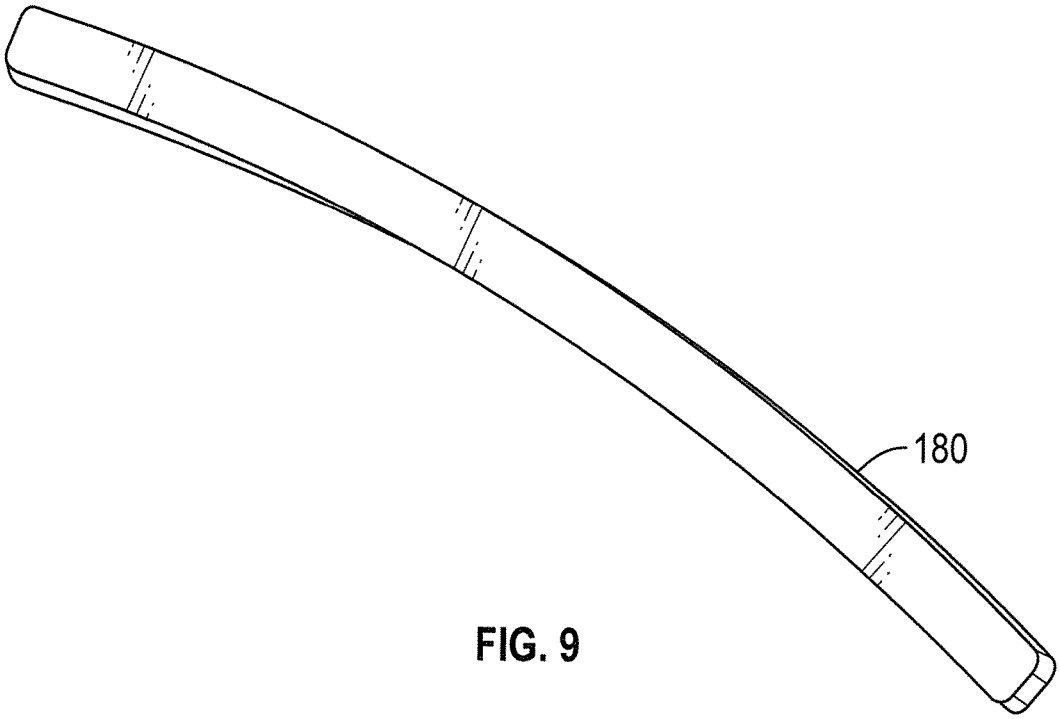
FIG. 9 is a perspective view of a shim of the middle shim assembly.
Figure 10:
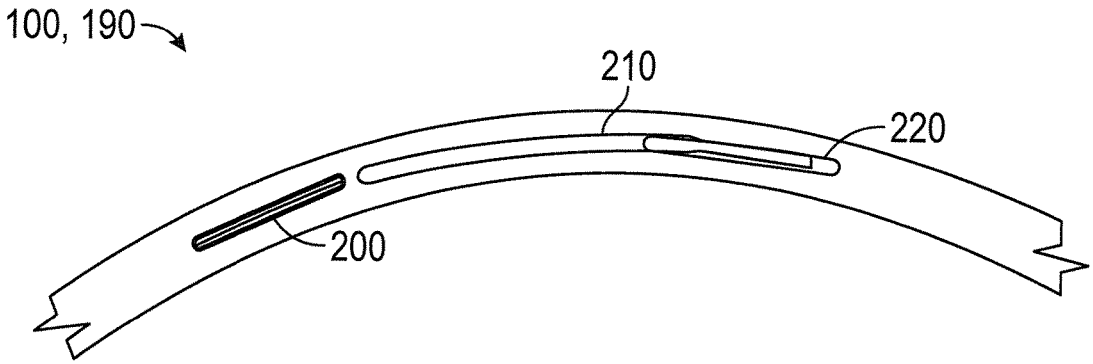
FIG. 10 is a bottom view of a bucket with a locking shim assembly of a radial support assembly as may be described herein.
Figure 11:
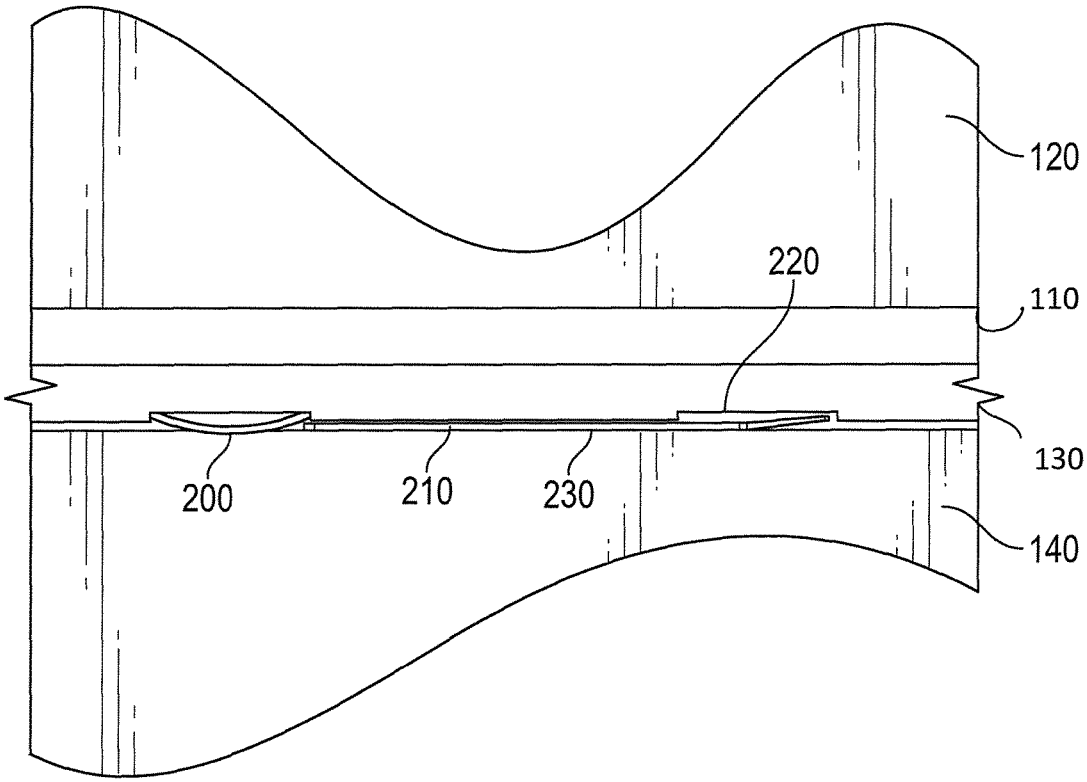
FIG. 11 is a side view of the locking shim assembly of the radial support assembly of FIG. 10.
Figure 12:
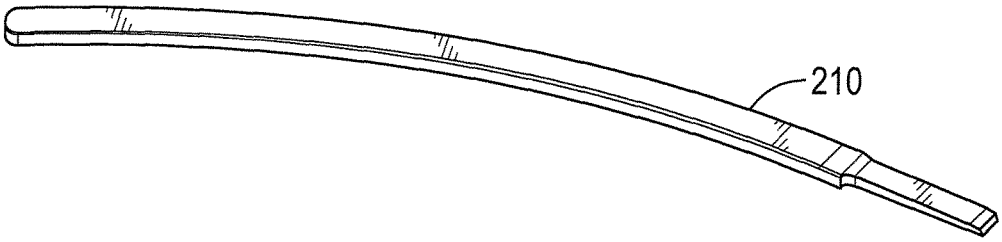
FIG. 12 is a perspective view of a locking shim of the locking shim assembly of FIG. 10.
Figure 13:
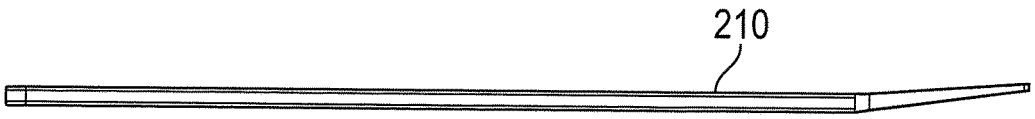
FIG. 13 is a perspective view of a locking shim of the locking shim assembly of FIG. 10.
Figure 14:
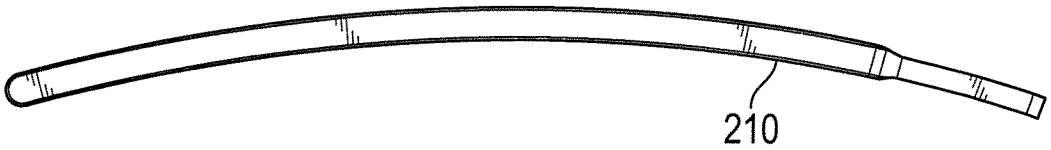
FIG. 14 is a perspective view of a locking shim of the locking shim assembly of FIG. 10.

Current options of using springs, "wedges", or tight dovetail fits all have limitations that are not desirable for the margin stage bucket assemblies 64, i.e., the later stages of each low pressure section 12, 14. Very large springs may be needed to provide enough radial force to overcome the 3-o'clock and 9-o'clock moment loading of the buckets 38. FIG. 5 shows the addition of a number of springs 66 into bucket spring pockets 68 on a bottom 70 of the dovetail 48. The large springs 66 may limit the robustness of the rotor design as the dovetail bottoms 70 must be of significant size and thereby increase the stress of the dovetail bottom 70 in the rotor wheel 16. Smaller springs may only take the weight of the bucket 38 at the 12-o'clock position and therefore may be cycled at the other side positions during rotor rotation. It is also difficult to install the springs 66 either during bucket installation or after bucket installation due to the very high radial forces needed.

Figure 4:
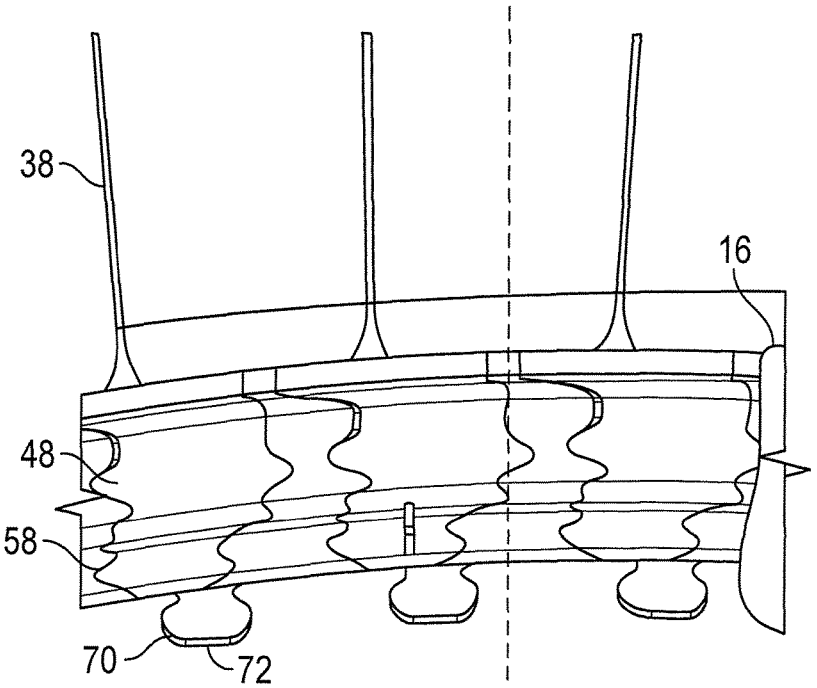
FIG. 4 is a side view of a bucket positioned in a rotor wheel.

Similarly, tight dovetail designs may be very limiting to the bucket 38 as the assembly becomes either difficult or impossible to assemble. There is some flexibility, i.e., movement, of the bucket 38 that is needed to get the last few buckets assembled because the tips 64 and/or the airfoils 50 do not allow for the direct slide in of the buckets 38. Finally, the wedge design has limitation as it is difficult to get wedges to work and be retained within a gap 72 between the bucket 38 and the rotor wheel 16 as is shown in FIG. 4. The wedge causes variability in the design and thermal transients in the design could cause high dovetail stresses. Adding end shims to the "closure group" buckets can be done but the axial retainment by caulking is not the most desirable method, though a practical method.

FIGS. 6-14 show an example of a radial support assembly 100 for use with a dovetail 110 of a bucket 120 and a dovetail slot 130 of a rotor wheel 140. Specifically, FIGS. 6-9 show a middle shim assembly 150. The middle shim assembly 150 includes a number of springs 160 positioned within number of bucket spring pockets 170 similar to those described above. The middle shim assembly 150 further may include a middle shim 180. The middle shim 180 may extend between the springs 160 and the bucket spring pockets 170. The middle shim 180 may have a precise thickness. One or more shim thicknesses may be used to achieve a desired minimum radial gap after bucket assembly. The shims 180 also may be machined to fit within current dovetail designs, particularly with the curved entry designs. The middle shim assembly 150 may be used for approximately 95% of the row while allowing some movement of the closure group as needed. Using the middle shim 180 in combination with the dual spring design allows for axial retention of the shim 180 while not requiring more expensive machining or retainment features. Other components and other configurations also may be used herein.

FIGS. 10-14 show a locking shim assembly 190 for use with the last few (5-8) buckets 120 to be assembled in the row (the "closure group"). In this example, only one spring 200 may be used. Instead of a pair of springs 160 and the middle shim 180 as described above, the locking shim assembly 190 may use a locking shim 210 with a tapered end. The locking shim 210 may extend from the spring 200 into an empty bucket spring pocket 220. After assembly of the entire row, the locking shim 210 may be inserted into a cavity 230 between the bucket dovetail 110 and the rotor dovetail slot 130. Once inserted fully into the cavity 230, the locking shim 210 engages the bucket pocket and locks itself in place. The locking shim 210 thus avoids a design that may use smaller end shims and avoids the peening (caulking) of the end shims in place to keep them retained axially. This is a robust yet inexpensive way to retain the shims and it is limited to only a very small number of buckets within the stage. It also would appear that this design would work with thicker shim blocks (larger than about 0.12 inches thick (about 3.1 millimeters)) such that they can be pushed or tapped into place from the end. Other components and other configurations may be used herein.

The radial support assembly 100 thus provides for a less costly design because of the simplified spring design with lower radial force. This design allows for a more robust rotor design as the dovetail bottom does not need to be significantly wide to accommodate large width springs. This design allows for bucket movement when needed during assembly yet allows for a limited movement assembly after the row is assembled. This design uses the existing spring configuration as retainment for the shim configuration. Fit during assembly is not required for each bucket/wedge design limitation.

Figure 15:
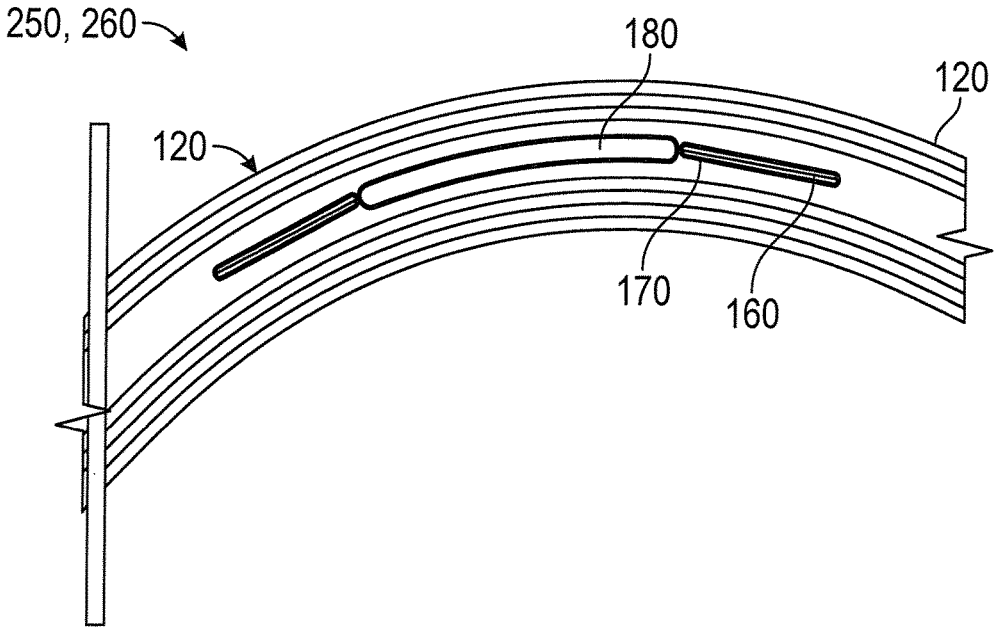
FIG. 15 is a bottom view of a bucket with a middle shim assembly of a radial support assembly as may be described herein.
Figure 16:
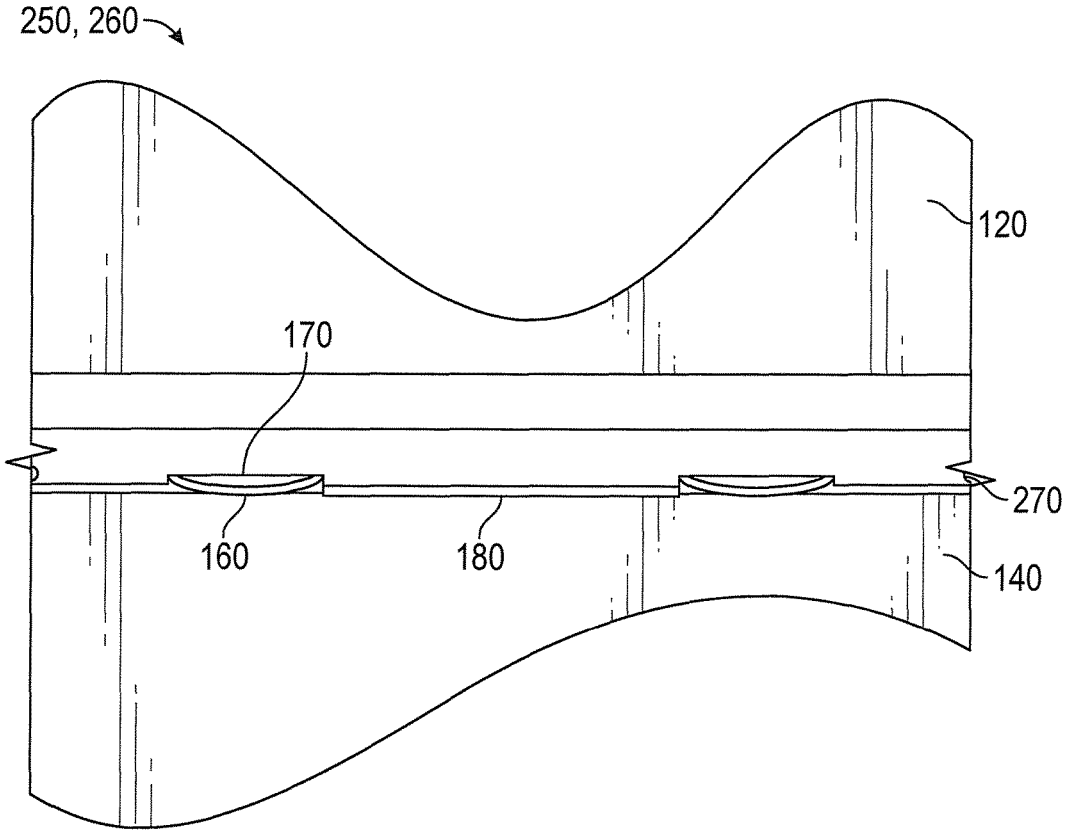
FIG. 16 is a side view of the middle shim assembly of the radial support assembly of FIG. 15.

FIGS. 15-16 show an example of an alternative embodiment of a radial support assembly 250. The radial support assembly 250 may be used with the dovetail 110 of the bucket 120 and the dovetail slot 130 of the rotor wheel 140. Specifically, FIGS. 15 and 16 show a middle shim assembly 260. Similar to that described above, the middle shim assembly 260 includes a number of springs 160 positioned in number of bucket spring pockets 170. The middle shim assembly 260 may further include the middle shim 180. The middle shim 180 may extend between the springs 160 and the bucket spring pockets 170. The bucket dovetail 110 may include one or more stake blade dovetail corners 270.

Figure 17:
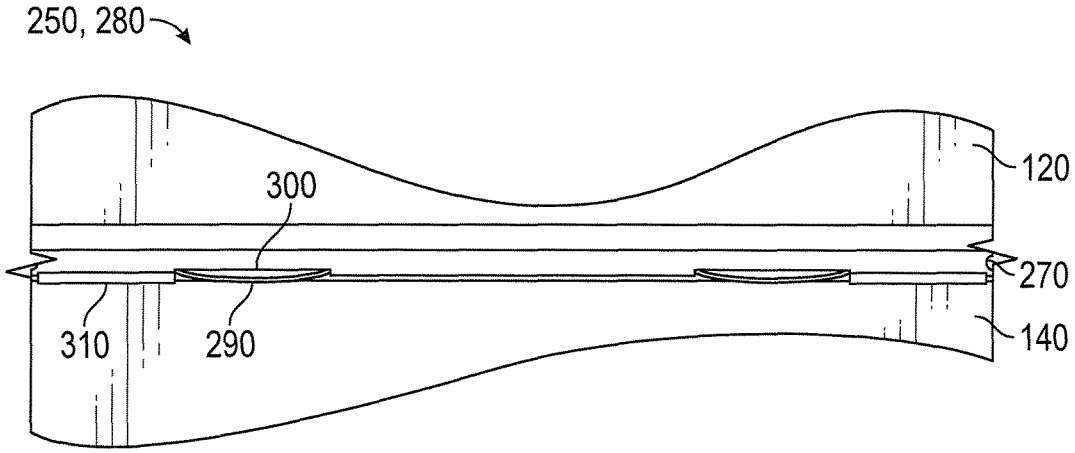
FIG. 17 is a side view of a bucket with a locking shim assembly of a radial support assembly as may be described herein.
Figure 18:
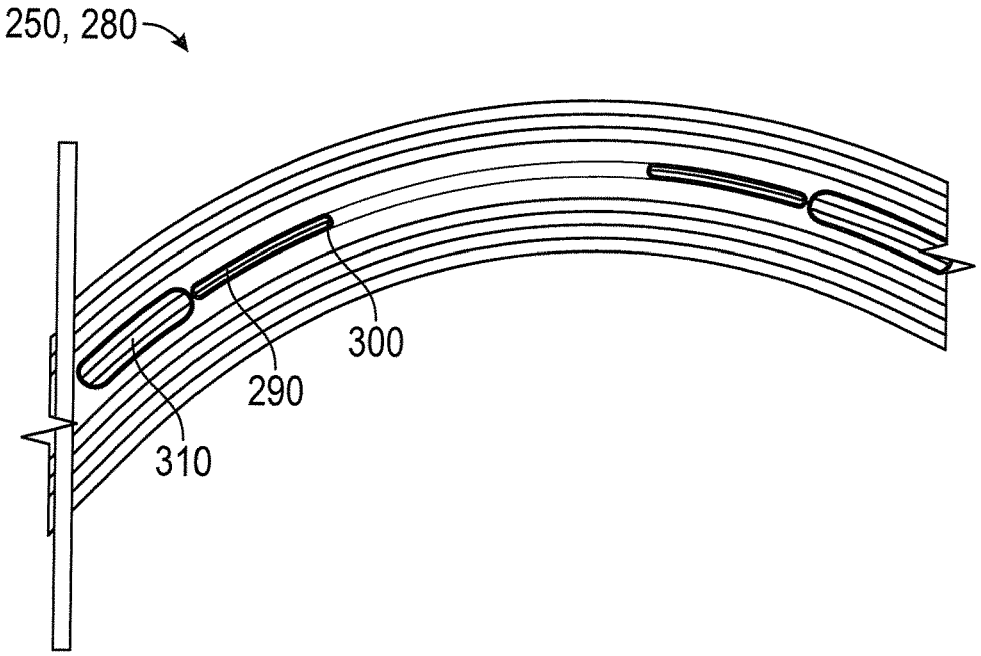
FIG. 18 is a bottom view of the locking shim assembly of the radial support assembly of FIG. 17.
Figure 19:
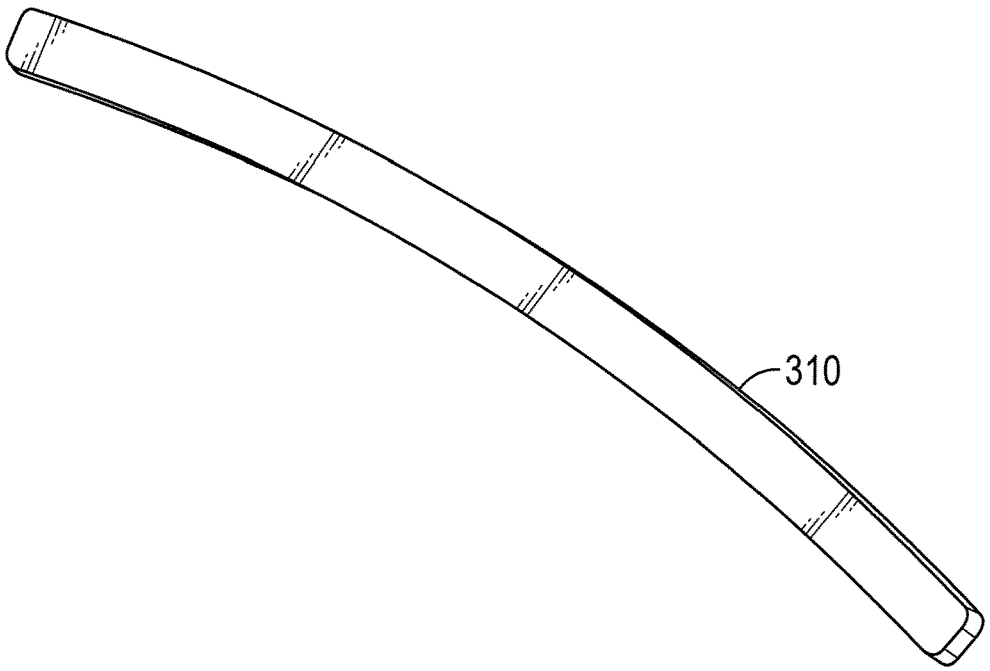
FIG. 19 is a perspective view of an end shim of the locking shim assembly of FIG. 17.

FIGS. 17-19 show a locking shim assembly 280 for use with the last few (5-8) buckets 120 to be assembled in the row closure group. A pair of springs 290 may be positioned within a pair of bucket spring pockets 300 similar to those described above. In this example, the locking shim assembly 280 may use a pair of end shims 310. The end shims 310 may extend from the springs 290 outward towards the stake blade dovetail corners 270. Other components and other configurations may be used herein.

The end shims 310 may be used to achieve the proper radial gap limitation to the bucket 120. The end shims 310 then would be retained axially by a peeing or caulking operation at the bucket dovetail corner that is at the bottom of the dovetail 110. This area of the dovetail 110 has relatively low stress and a small peening over of material is acceptable. This is a robust yet inexpensive way to retain the shims and it is limited to only a very small number of buckets within the stage.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A steam turbine, comprising:

a plurality of rotor wheel slots;

a plurality of buckets positioned in the plurality of rotor wheel slots; and a radial support assembly positioned between each of the plurality of buckets and each of the plurality of rotor wheel slots;

the radial support assembly comprising one or more springs and one or more shims positioned laterally adjacent to each other;

wherein the one or more shims comprise a middle shim; and wherein the one or more springs comprise a first spring on a first side of the middle shim and a second spring on a second side of the middle shim.

2. The steam turbine of claim 1, wherein each of the plurality of buckets comprises a dovetail.

3. The steam turbine of claim 2, wherein each of the plurality of rotor wheel slots comprises a dovetail slot.

4. The steam turbine of claim 1, wherein the radial support assembly comprises one or more spring pockets.

5. The steam turbine of claim 1, wherein each of the plurality of buckets comprises one or more stake blade dovetail corners.

6. The steam turbine of claim 1, wherein the one or more shims comprise an end shim.

7. The steam turbine of claim 6, wherein the one or more shims comprise a pair of end shims.

8. The steam turbine of claim 7, wherein the one or more springs comprise a pair of springs within the pair of end shims.

9. A steam turbine, comprising:

a plurality of rotor wheel slots;

a plurality of buckets positioned in the plurality of rotor wheel slots; and a radial support assembly positioned between each of the plurality of buckets and each of the plurality of rotor wheel slots;

the radial support assembly comprising one or more springs and one or more shims positioned laterally adjacent to each other;

wherein the one or more shims comprise a locking shim; and wherein the radial support assembly comprises a pair of spring pockets.

10. The steam turbine of claim 9, wherein the radial support assembly comprises a locking shim cavity.

11. The steam turbine of claim 9, wherein the locking shim comprises a tapered end.

12. The steam turbine of claim 9, wherein each of the plurality of buckets comprises a dovetail.

13. The steam turbine of claim 12, wherein each of the plurality of rotor wheel slots comprises a dovetail slot.

14. The steam turbine of claim 9, wherein each of the plurality of buckets comprises one or more stake blade dovetail corners.

15. The steam turbine of claim 9, wherein the locking shim comprises an end shim.

16. The steam turbine of claim 15, wherein the locking shim comprises a pair of end shims.

17. The steam turbine of claim 16, wherein the one or more springs comprise a pair of springs within the pair of end shims.

18. A method of bucket assembly on a rotor wheel, comprising:

the rotor wheel having a plurality of rotor wheel slots;

axially inserting each of a plurality of middle buckets into a respective one of the rotor wheel slots;

positioning a middle shim assembly between each of the plurality of middle buckets and their respective rotor wheel slot;

axially inserting each of a plurality of locking buckets into a respective one of the rotor wheel slots; and positioning a locking shim assembly with a locking shim having a tapered end between the plurality of locking buckets and their respective rotor wheel slots.

* * * * *